US008847052B2

(12) United States Patent
Alsmeyer et al.

(10) Patent No.: US 8,847,052 B2
(45) Date of Patent: Sep. 30, 2014

(54) ORCHESTRAL PEG TURNING DEVICE

(75) Inventors: Sasha Wang Alsmeyer, Vaughan (CA); Daniel Charles Alsmeyer, Vaughan (CA); Lisa Ann Berman, Eden Prairie, MN (US); Sheila R. Graves, New Hope, MN (US); Lyle Wayne Knudson, Monticello, MN (US); Daniel A. Freiberg, Golden Valley, MN (US); James Clair Burkhouse, Jr., Bradford, PA (US)

(73) Assignee: Lisa Ann Berman, Eden Prairie, MN (US)

( * ) Notice: Subject to any disclaimer, the term of this patent is extended or adjusted under 35 U.S.C. 154(b) by 165 days.

(21) Appl. No.: 13/572,300

(22) Filed: Aug. 10, 2012

(65) Prior Publication Data

US 2013/0036891 A1 Feb. 14, 2013

Related U.S. Application Data

(60) Provisional application No. 61/574,899, filed on Aug. 11, 2011.

(51) Int. Cl.
*G10D 9/00* (2006.01)
*G10D 3/00* (2006.01)

(52) U.S. Cl.
CPC ..... *G10D 3/006* (2013.01)
USPC ..... 84/453

(58) Field of Classification Search
CPC ..... G10H 1/00; G10H 1/44; G10D 3/00; G10G 5/00
USPC ..... 84/458, 453; D17/20
See application file for complete search history.

(56) References Cited

U.S. PATENT DOCUMENTS

| | | | | |
|---|---|---|---|---|
| 6,294,719 | B1 * | 9/2001 | Palecki et al. | 84/458 |
| 7,301,089 | B1 * | 11/2007 | Liao | 84/453 |
| 2007/0193430 | A1 * | 8/2007 | Jang | 84/313 |

* cited by examiner

*Primary Examiner* — Jianchun Qin
(74) *Attorney, Agent, or Firm* — Dorsey & Whitney LLP

(57) ABSTRACT

A peg turner for a stringed instrument includes an elongate body portion extending along an axis. The body portion defines first and second opposing ends. A recess is formed in the first end of the body portion, and a tapered peg turner slot is formed in the recess. The tapered peg turner slot includes an opening at the first end of the body portion, sized to accept a tuning peg of a string instrument. Tapered sides extend from the opening along the rotational axis toward the second end of the body portion, tapering inward to form a compressive coupling for turning the selected peg about the axis with the body portion of the peg turner.

21 Claims, 12 Drawing Sheets

ORCHESTRAL PEG TURNING DEVICE

CROSS-REFERENCE TO RELATED APPLICATIONS

This application claims priority to Alsmeyer et al., U.S. Provisional Application No. 61/574,899, filed Aug. 11, 2011, entitled PEG-ASSIST ORCHESTRAL PEG TURNING DEVICE, the entirety of which is incorporated by reference herein.

BACKGROUND

This invention relates generally to stringed instruments, and specifically to a peg turning device for use in tuning stringed orchestral instruments. In particular, the invention relates to a peg-assist or peg turning device for use with stringed instruments in the violin family, and other stringed instruments utilizing a tuning peg and peg box or "pegbox" mechanism.

There are a number of instruments in the orchestral string family such as the violin or fiddle, viola, and cello, ranging up in size to the double bass or contrabass. These instruments are largely hand-made and come in a variety of shapes and sizes to accommodate the player's stature. Violin sizes range from student-sizes, which are quite small, to a variety of standard full sizes.

The viola family is essentially similar to the violin family but is slightly larger. The cello is an even larger instrument and similarly comes in a wide variety of sizes, as does the bass. Other instruments have similar architectures and size ranges, for example the viol or viola de gamba, lira de braccio, and bass violin.

Such orchestral and other string instruments are typically designed with a multitude of strings that extend from the base of the instrument to a wooden peg box comprising a number of wooden pegs for tuning specific strings to a desired frequency. Tuning pegs typically are designed with a thin stem and a flat peg head. The thin stem is inserted into the peg box around which a string is wound. A large flat peg head extends beyond the peg box and facilitates turning the thin stem such that the tension on the string can be increased or decreased. Like the hand-made instruments, tuning pegs are often hand-made and are constructed in a wide variety of dimensions and sizes.

Traditional tuning of an instrument involves grasping the flat peg head between the thumb and forefinger and providing a twisting motion. As both the peg box and pegs are constructed from wood material, they are subject to swelling and shrinkage as the instrument experiences different temperatures and humidity. This expansion and contraction sometimes causes pegs to stick and otherwise be difficult to turn. The pinching force required between the thumb and forefinger can also be considerable, and an individual who tunes multiple instruments (e.g., a teacher for a youth orchestra) may experience repetitive motion fatigue or injury, or may discover that the force needed to turn the peg exceeds their strength.

SUMMARY

This invention concerns a peg turner for a stringed instrument having a plurality of tuning pegs in a peg box, a method of making the peg turner, and a peg turning device having features of the peg turner. The peg turner has an elongate body portion extending along an axis, with first and second opposing ends. A recess is formed in the first end of the body portion, and a tapered peg turner slot is formed in the recess.

The tapered peg turner slot has an opening on the first end of the body portion, and the opening is sized to accept a selected tuning peg of the stringed instrument. The tapered sides taper inward along the axis from the opening toward the second end of the body portion, and are configured to form a compressive coupling for turning the selected peg about the axis with the body portion of the peg turner. A soft material layer may be provided on an interior surface of the tapered sides, so that the soft material layer forms the compressive coupling.

DETAILED DESCRIPTION

Figure 1:
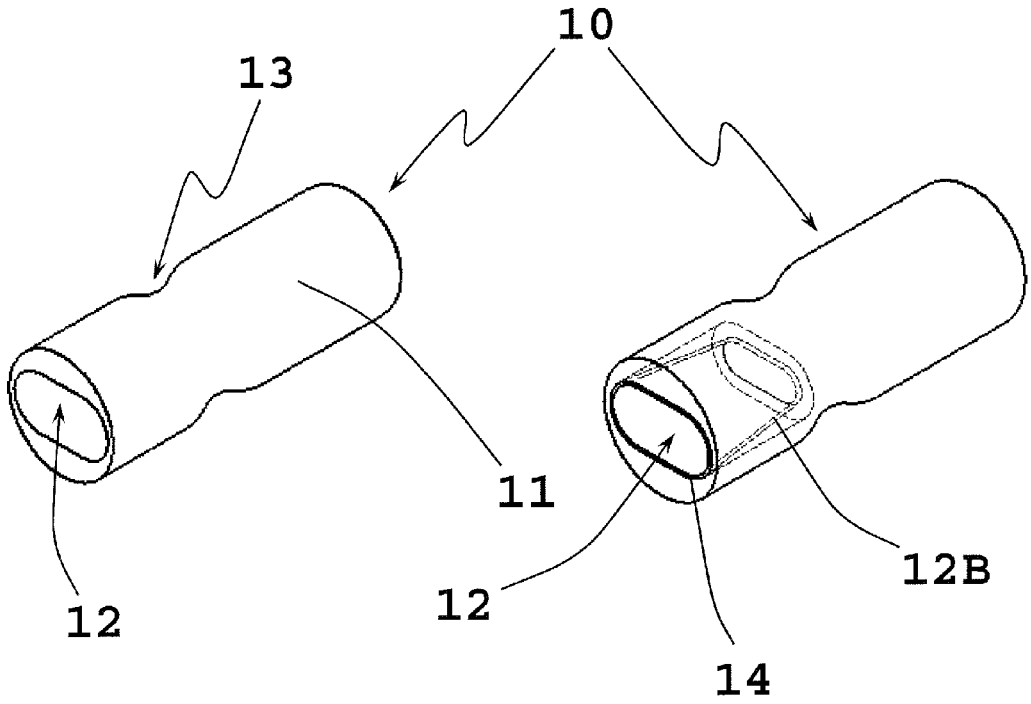
FIG. 1 shows a diagram of a peg turner with a slot and finger grip groove.

Some individuals generally have less grip strength than others, and often may have difficulty tuning their or their students' instruments, particularly in summer where the pegs, traditionally made of wood, swell in the peg box. Because of this, turning the pegs can be nearly impossible without a tool and can cause injury even to the healthy hand, because the force needed to turn the peg exceeds the force they can apply without injury. Because of lack of strength or injuries, some individuals may also apply force with their shoulders and/or arms (using compensatory muscles), risking damage to these muscle groups as well. Those with neck injuries, also common in violin and other string players, may also exacerbate these injuries by turning "difficult" or "stuck" pegs.

Because a player bows the instrument with their right hand, tuning pegs are typically turned with the left hand. This is the non-dominant hand for the majority of the population, as well as the vast majority of string players. Further, the peg heads are set at an angle determined by tuning and set-up, rather than by the ideal angle for applying force.

This invention can tune a peg that is set at any starting angle. In addition, grip strength and force decreases with age, yet older individuals are otherwise able to play string instruments because very little force is required. Thus, this device can extend the amount of time that an older individual can play or teach a string instrument.

This invention achieves these advantages and overcomes these difficulties by creating a device with a larger hand grip and a slot that snugly fits over the tuning peg and that fits nearly any size or shape of peg currently available. Incorporation of multiple sized tapered slots accommodates additional instruments or instrument sizes. While the elongated hand grip may be of any shape, it is preferably cylindrical, like a broomstick or screwdriver handle, in either substantially rounded or multi-sided (multi-faceted) form.

A cylindrical or substantially rotationally symmetric handle or peg turner body shape permits a larger area upon which to grasp, providing more torque to twist the peg and tune the instrument. Further, the hand grip handle is grasped about the palm of the hand instead of by a pinching motion between the thumb and finger, increasing the applicable turning force while decreasing stress and strain on the fingers and hand, and reducing the risk of injury to the user.

In various designs and embodiments, this invention relates to a device that assists the ability to tune orchestral instruments. The device generally consists of an elongated handle with a slot. By providing a larger area handle, an alternate and better grip, the device enables movement of "stuck" pegs and reduces or minimizes the possibility of repetitive motion type injuries. This invention may also be designed with a tapered peg slot that engages a wide variety of peg styles and sizes.

In one class of embodiments, this invention relates to a device that slips over the head of an orchestral string instrument peg and eases the ability to turn the peg and tune the instrument. The device generally consists of an elongated handle with a slot. The large area of the elongated handle permits an alternate and better grip that facilitates motion of a peg that has become "stuck" in the peg box and minimizes the possibility of repetitive motion type injuries. Such injuries are particularly deleterious for string players whose method of income relies on the health of their wrists, arms, and hands.

In additional embodiments, this invention is designed with a peg slot that engages a wide variety of peg styles and sizes. To accommodate the wide range of peg sizes, this invention contemplates creating a slot with tapered walls so that a multitude of peg sizes and dimensions fit snugly into the slot.

Smaller and larger versions of the peg turner device that accommodate smaller student size violins and larger instruments such as a cello are also envisioned. These can be combined into a single device, or two or more devices, such that a majority or even substantially all instruments of the modern string family can be tuned with a single turner.

Orchestral instruments are constructed from wood and are subject to scratching and damage. For this reason, it is preferable to cover the inner walls of the slot with a soft material layer such as leather to minimize the chance of damage while using the invention. It is also preferable to cover the top of the turner in a softer material to prevent damage to the peg box.

This invention finds utility in violin shops where many "stuck" pegs that need to be moved without damage to the peg, peg box, or instrument, or injury to the luthier, are often encountered. There is also substantial utility for the student level orchestra conductors such as public school orchestra teachers, who may need to tune up to a hundred string instruments per day as quickly as possible.

This device makes tuning an instrument much faster and more efficient, similar to using a screw driver rather than trying to use one's hands to install screws, but with additional features particularly adapted to the problem of turning pegs to tune, build, repair or maintain a wide range of different stringed instruments. In addition, when new strings are installed on a string instrument it can take days for the tuning to stabilize. This peg tuner helps speed the tuning stability of new strings and also can increase stability of tuning for strings that have already stretched but tend to de-tune frequently. There are no tools currently used in violin shops or elsewhere that have these features and perform these functions, as described herein, to assist in installing, turning or removing any peg in a peg box of a stringed instrument, stuck or otherwise, substantially like the peg-assist or peg turning device of this invention.

Shops, moreover, need to tune instruments all day to show and work on them. The invention speeds tuning and increases stability of strings in general. Solo and orchestral string players also rely on healthy arms, necks, shoulders, hands, thumbs, and fingers for their continued ability to work, and thus take care to avoid putting these muscle groups at any risk. This invention reduces or minimizes the chance of occupational injury and disability for such persons, and provides additional advantages as described below.

FIG. 1 provides an illustration of a standard size peg turner for use in turning instrument pegs with a range of sizes, for example in violins, violas, and similar applications, showing external (left) and internal features (right), respectively. A typical standard size peg turner, 10, consists of an elongated body, 11, with a slot, 12. In the particular examples of FIG. 1, a cylindrical elongated body, 11, may be configured with a hand knurl or groove, 13, for improved hand gripping, torque transfer and turning performance with more ergonomically applied force and mechanical advantages by positioning the user's hand for torque and force from the user's palm to the peg turner body or handle, 11, rather by coupling primarily with the fingers and thumb, as in other designs. The slot, 12, may consist of tapered internal walls, 12B, that enable a wide variety of instrument pegs to fit securely within the slot, 12. The tapered walls, 12B, may be covered with a soft material layer, 14, such as leather, rubber, or latex, to minimize the chance of scratching or damaging the instrument peg.

Figure 2:
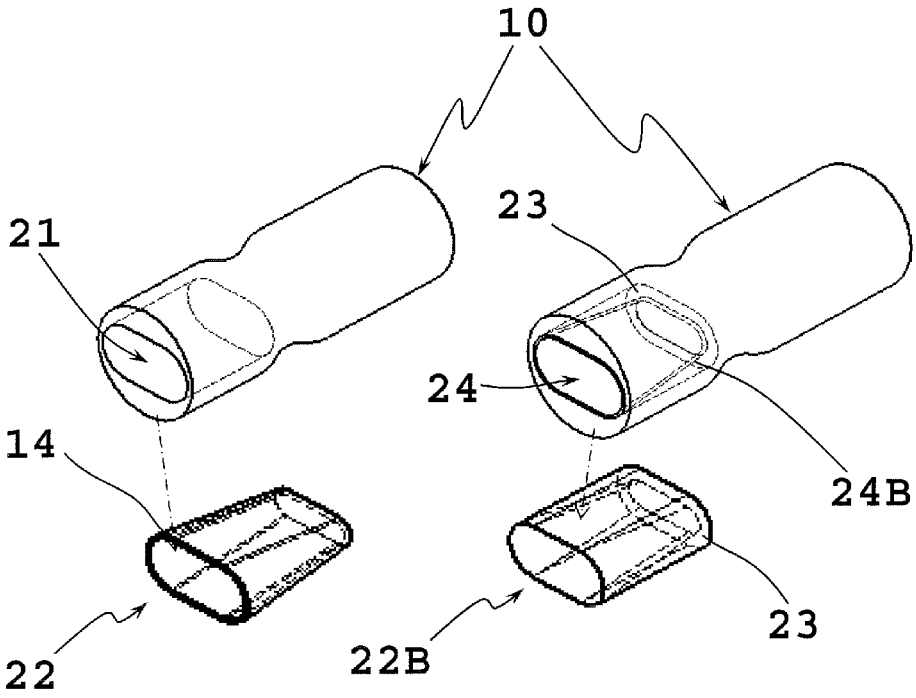
FIG. 2 provides an illustration of the peg turner with a tapered slot design.

A method for creating a peg turner, 10, having a tapered slot, 24, with a soft material layer, 14, is illustrated in FIG. 2, which provides exploded views of peg turners, 10. An ovate cylindrical or oblong hole or recess, 21, is formed on one end of an elongated body, for example an elongated cylindrical or multi-sided (multi-faceted) body, 11, of a peg turner, 10. A tapered plug, insert or form, 22, is covered with a soft material layer, 14. The ovate cylindrical hole, 21, is at least partially filled and coated with a hardening resin, 23, for example an epoxy or glue resin, or, alternatively, a plastic or thermoplastic based polymer glue or resin material, with or without binder and filler materials, and the tapered plug insert or form, 22, with soft material layer, 14, is inserted into the hole or recess, 21, and retained until the hardening resin or glue, 23, sets into a solid form, or until soft material 14 is bonded to the glue or resin, 23, in the shape of the tapered sides, 12B.

The tapered plug or insert, 22, may then be removed to reveal a tapered slot, 24, for example as formed in accordance with tapered slot 12 of FIG. 1, above, with a soft material layer, 14, bonded to the resin or glue, 23, inside the recess, 21. Alternatively, insert 22B is formed together with resin, glue, or filler material, 23, forming slotted insert 22B, which is bonded or pressed to fit into the recess, 21. In each method, soft material layer, 14, conforms to the shape of the tapered walls, 24B, inside the tapered slot, 24, in order to accommodate a variety of peg sizes for tuning different musical instruments, for example as described above for a tapered slot, 12, with tapered walls, 12B.

Figure 3:
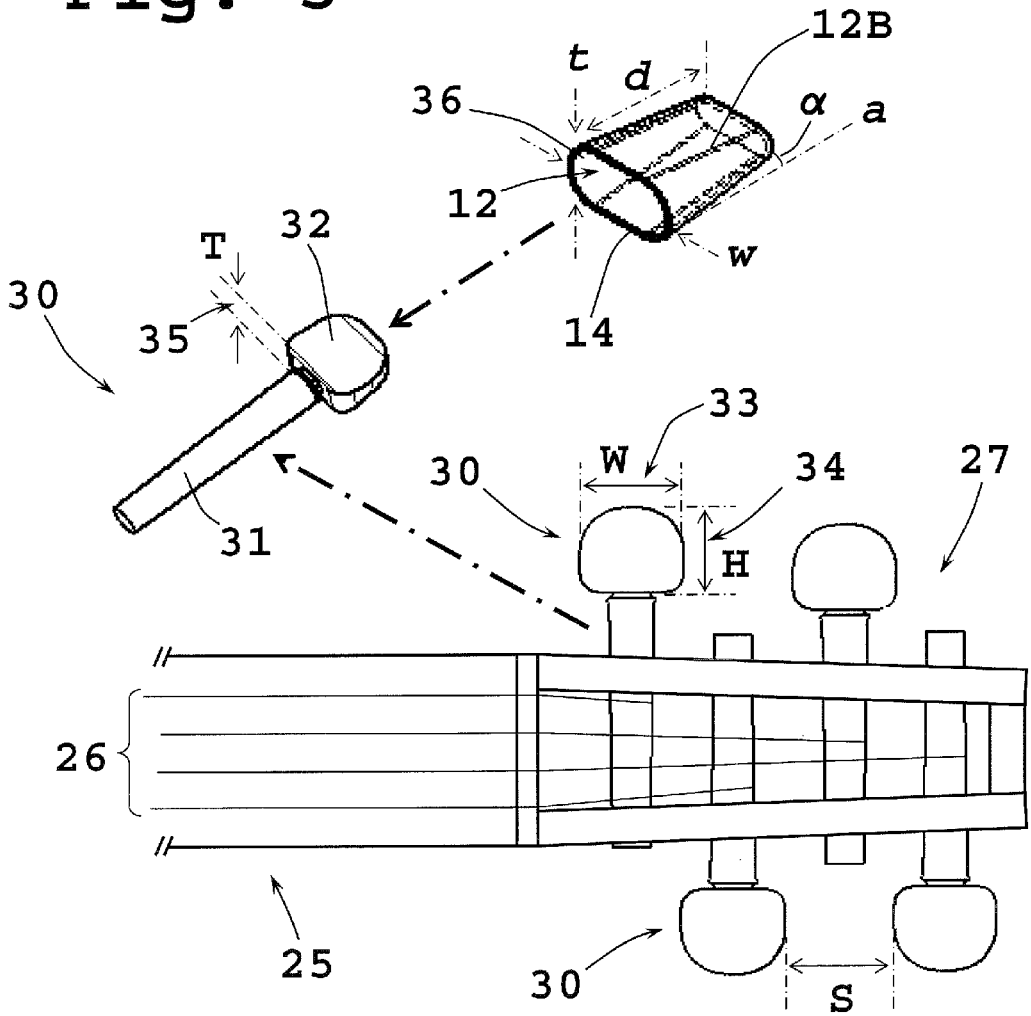
FIG. 3 shows an example instrument peg box and peg design.

Instrument pegs come in a wide variety of shapes and sizes depending on the particular type and form of the musical instrument, 25, strings, 26, and peg box, 27, with correspondingly different peg spacing, S. A typical general shape of the tuning peg, 30, for one or more orchestral string instruments (e.g. violins, violas, stringed orchestral bass instruments, and cellos), 25, is shown in FIG. 3. As shown in the figure, a peg, 30, for an orchestral string instrument consists of stem, 31, and head, 32. The head, 32, typically has or may have a generally ovate or oblong, substantially flat shape with a head width, 33 (W), head height, 34 (H), and head thickness, 35 (T), where T<H and T<W to define a substantially flat head, 32.

The peg spacing, S, characterizes the diameter of the peg turner shaft. For example, a cello or contrabass sized turner head may in general have a larger diameter than a for a violin or viola, based on the peg spacing, S, and peg width W. Where the pegs, 30, are turned horizinlally, as shown in FIG. 3, the on-center peg spacing is S+W, and the head diameter is generally selected to be less than S+W in order to avoid interference. More particularly, the head diameter may be selected to be larger than W (to accommodate the peg, 30) and smaller than W+S, to avoid interference with the adjacent pegs, 30. Alternatively, the head diameter may be selected to be larger than W and smaller than W+S/2, for improved spacing tolerance between adjacent pegs, 30.

Orchestral string instruments are often handmade and are not created with standard shapes and dimensions W, H, and T. Table A below provides a table of peg dimension measurements taken from a sampling of violin and viola pegs. Table B below provides a table of peg dimension measurements taken from a sampling of cello pegs.

The wide variety of measurements in Tables A and B indicates the challenge associated with creating a single slot design that encompasses and accommodates a suitable range of all different peg sizes and shapes. The desired or selected variety of pegs generally falls into three categories: small or student sized pegs, standard sized pegs, and large or cello pegs. A judicious choice of taper angle, a, and slot depth, d, allows the manufacture of peg turners in sizes that accommodate a large percentage of the available instrument pegs.

For example, a suitable slot, 12 (or 24), may have slot width (w) and slot depth (d) of about one half inch to about one and one half inches, or, alternatively, about 10 mm to about 40 mm, in order to accommodate a selected range of violin and viola peg widths and heights as indicated by Table A. Similarly, the slot may have a breadth or thickness (t) of about two tenths of an inch to about one half inch, or, alternatively, about 5 mm to about 15 mm, in order to accommodate a corresponding range of peg thicknesses.

In these designs, the slot width (w), depth (d) and breadth (t) span the range of dimensions for accommodating a peg, 30, with head, 32, at the opening, 36, of the slot, 12; that is, within the dimensions of the soft material layer, 14, at the opening, 36. The fit may be generally snug with respect to the head, or may include a tolerance on one or the other side of about a tenth of an inch or more, or, alternatively, about 1-2 mm, or about 3 mm, or more.

Within the slot, 12, the width and thickness dimensions, w, and d, generally decrease along the slot depth, d, from the opening, 36, and along the tapered walls, 12B, so that the peg, 30, may be accommodated with such a range of different tolerances and snugness of fit for peg width, W, and thickness, T, with respect to the soft material layer, 14. This design, in which the peg turner body, 11, is substantially rotationally symmetric about the rotational axis, provides the required degree of compressive coupling to the head, 32, of the selected tuning peg, 30, and positions the user's hand for the required degree of torque and force transfer from the hand or palm of the user through coupling between the palm and the peg turner body rather than coupling primarily through the fingers and thumb, in order to overcome the static friction and stationary binding forces required to turn "stuck" pegs, 30, with less risk of damage to the head, 32, or shaft, 31, of the peg, 30, and with reduced risk of injury to the user.

TABLE A

Violin and Viola Peg Data

| | Peg Head Dimensions (inches) | | |
|---|---|---|---|
| Peg # | Width (W) | Height (H) | Thickness (T) |
| 1 | 0.683 | 0.550 | 0.330 |
| 2 | 0.790 | 0.700 | 0.387 |
| 3 | 0.845 | 0.778 | 0.424 |
| 4 | 0.641 | 0.531 | 0.353 |
| 5 | 0.588 | 0.528 | 0.327 |
| 6 | 0.629 | 0.482 | 0.269 |
| 7 | 0.602 | 0.515 | 0.253 |
| 8 | 0.876 | 0.721 | 0.440 |
| 9 | 0.834 | 0.777 | 0.382 |
| 10 | 0.972 | 0.870 | 0.353 |
| 11 | 0.902 | 0.703 | 0.482 |
| 12 | 0.681 | 0.667 | 0.374 |
| 13 | 0.700 | 0.634 | 0.442 |
| 14 | 0.728 | 0.711 | 0.418 |
| 15 | 0.751 | 0.663 | 0.402 |
| 16 | 0.829 | 0.679 | 0.375 |
| 17 | 0.741 | 0.662 | 0.429 |
| 18 | 0.781 | 0.690 | 0.403 |
| 19 | 0.750 | 0.675 | 0.425 |
| 20 | 0.773 | 0.674 | 0.402 |
| 21 | 0.875 | 0.740 | 0.405 |
| 22 | 0.902 | 0.772 | 0.405 |
| 23 | 0.883 | 0.674 | 0.434 |
| 24 | 0.830 | 0.709 | 0.423 |
| 25 | 0.864 | 0.727 | 0.361 |
| 26 | 0.864 | 0.748 | 0.431 |
| 27 | 0.931 | 0.799 | 0.419 |
| 28 | 0.894 | 0.793 | 0.459 |
| 29 | 0.883 | 0.797 | 0.405 |
| 30 | 0.902 | 0.786 | 0.505 |
| 31 | 0.858 | 0.818 | 0.428 |
| 32 | 0.912 | 0.744 | 0.462 |
| 33 | 0.913 | 0.732 | 0.356 |
| 34 | 0.880 | 0.746 | 0.436 |
| 35 | 0.833 | 0.695 | 0.400 |
| 36 | 0.903 | 0.790 | 0.408 |
| 37 | 0.989 | 0.825 | 0.482 |
| 38 | 0.867 | 0.752 | 0.488 |
| 39 | 0.914 | 0.819 | 0.454 |
| 40 | 0.871 | 0.788 | 0.440 |

In alternative designs, for example as applicable to a violas, cellos, contrabass instruments and other, generally larger (or smaller) stringed instruments, the slot dimensions, w, h, and d, may vary. For example, in cello or contrabass applications, a suitable slot (e.g., slot 12 or 24) may have slot width (w) and slot depth (d) of about one half inch to about two inches, or, alternatively, about 20 mm to about 60 mm, in order to accommodate the same or a different selected range of cello and bass peg widths and heights, as indicated by Table B. Similarly, the slot may have a breadth or thickness (t) of about half an inch to about one inch, or, alternatively, about 10 mm to about 30 mm, in order to accommodate a corresponding range of peg thicknesses.

TABLE B

| Cello Peg Data | | | |
|---|---|---|---|
| | Peg Head Dimensions (inches) | | |
| Peg # | Width (W) | Height (H) | Thickness (T) |
| 1C | 1.443 | 1.262 | 0.619 |
| 2C | 1.476 | 1.257 | 0.671 |
| 3C | 1.540 | 1.339 | 0.680 |
| 4C | 1.302 | 1.432 | 0.539 |
| 5C | 1.371 | 1.326 | 0.687 |
| 6C | 1.486 | 1.254 | 0.671 |
| 7C | 1.447 | 1.347 | 0.701 |
| 8C | 1.494 | 1.295 | 0.663 |
| 9C | 1.641 | 1.307 | 0.723 |

In each of the above embodiments, manufacturing tolerances vary. In one design, for example, the width, w, thickness or breadth, t, and length or depth, d, of the slot, 12 or 24, may vary by an absolute tolerance, for example about one tenth of an inch or a quarter of an inch, alternatively about 2 mm to about 5 mm or about 8 mm, or more or less, as defined at the opening, 36, of the slot, 12 or 24. In other designs, the width, w, thickness or breadth, t, and length or depth, d, of the slot, 12 or 24, may vary by a relative tolerance, for example about five percent or less, or about five to about ten percent, or about ten percent to about twenty or more, as defined by the width, w, and breadth, t, at the opening, 36, of the slot, 12 or 24, and along the slot depth, d.

The characteristics of the tapered walls, 12B (or 24B), also vary, depending upon design, application and embodiment. In some applications, for example, the tapered walls, 12B, are tapered inward (toward decreasing width, w, and thickness, t), by an angle, $\alpha$, of about 1 degree or about 2 degrees to an angle of about 5 degrees, or at an angle of about 2 degrees to about 10 degrees, for example at an angle of about 1-2 degrees, at an angle of about 2-5 degrees, or at an angle or about 2-10 degrees.

Alternatively, the tapering is at an angle of about 2 degrees, about 5 degrees, or about 5-10 degrees, or more. More generally, the taper angle, $\alpha$, may be selected or determined with approximately the same value with respect to decreasing width, w, and decreasing thickness, t, or at different values with respect to decreasing width, w, and thickness, t, as defined along the depth, d, of the slot, 12 or 14, measuring inward from the opening, 36, along the axis of the peg turner.

Figure 4:
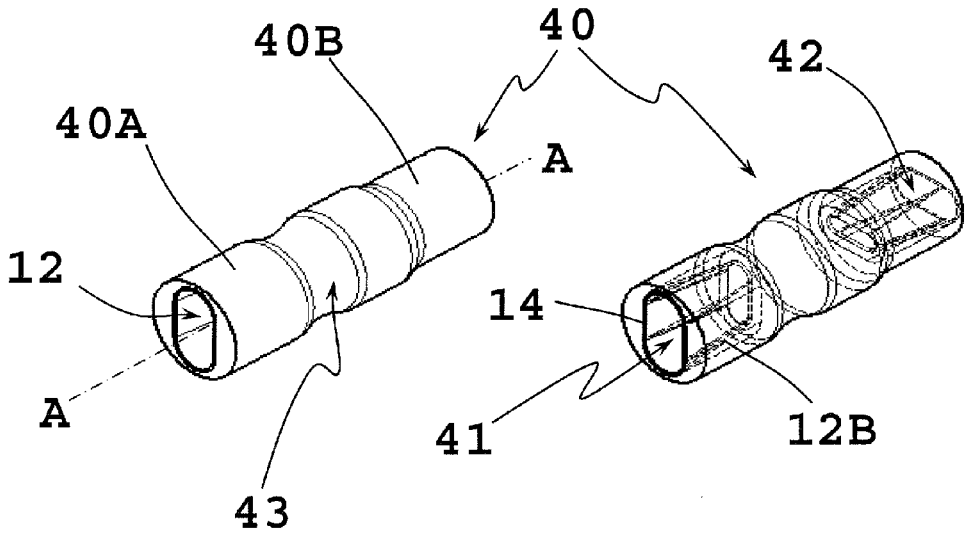
FIG. 4 illustrates a two-sided peg turner with multiple tapered slots.

FIG. 4 demonstrates a two sided peg turner, 40, for example peg turner 10, above, in external (left) an internal (right) views, consisting of standard sized peg slot, 41, and a smaller sized peg slot, 42, for example configured as slot 12 (or 24), above, on opposing ends, 40A and 40B, of the turner, 40, as defined along major rotational or turning axis A. An optional hand knurl, 43, for example knurl or gripping groove 13, above, may be incorporated between the opposing ends, 40A and 40B, for ease of grip, improved force and torque transfer from the palm to the peg turner, 40, and for aesthetic value.

Similar to the standard sized, one-slot peg turner, the two-sided peg turner slots, 41 and 42, are preferably formed with tapered walls, 12B, with varying taper angles $\alpha$, as described above, in order to accommodate a wider variety of peg sizes and dimensions. These tapered walls, 12B, are preferably covered with a soft material layer, 14.

It is envisioned that the tapered wall slots, 12, 41, or 42, may be formed in fashions similar to those for the standard sized or other sizes of peg turners, 10. The two sided peg turner, 40, comprises one end, 40A, with a standard size diameter, dimension, or size, and another end, 40B, with a smaller or larger diameter, dimension, or size, that will accommodate the smaller or larger distance between pegs on different student and teacher instruments.

Figure 5:
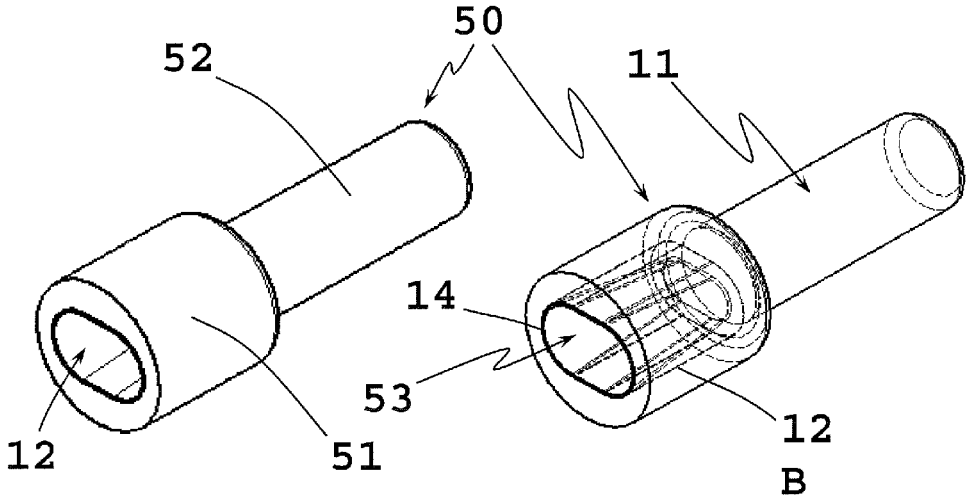
FIG. 5 is a peg turner design for larger instruments, such as cellos.

FIG. 5 illustrates a larger or smaller peg turner, 50, useful for accommodating larger or smaller pegs for instruments such as a cello, contrabass or student violin. Because cello, bass and student violin pegs, and other tuning pegs on other musical instruments, are substantially larger or smaller than violin or viola pegs, a larger or smaller peg turner head, 51, is provided, for example at a first end, 40A, of peg turner 10 or 40, as described above. The larger or smaller peg turner, 50, has a hand or palm grip, 52, and a larger or smaller peg turner slot, 53, for example at a second opposing turner end, 40B, opposite first end 40A. Similar to the standard sized peg turner slot shown in FIG. 1, and peg turner slots 12 and 24, 41 and 42, above, the larger or smaller peg slot, 53, may be formed in similar fashion to provide a soft material layer, 14, and tapered wall or walls, 12B.

Figure 6:
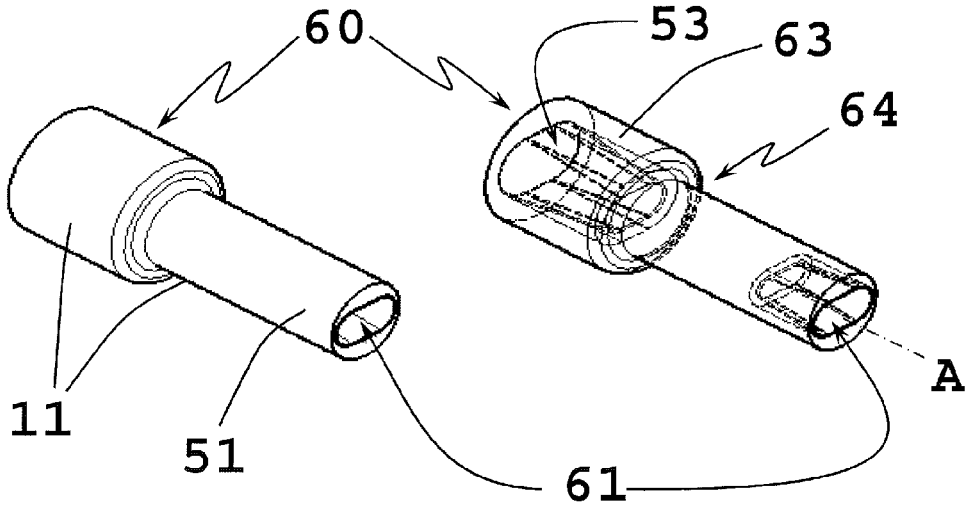
FIG. 6 demonstrates a multi-function peg turner for both larger instruments such as cellos and standard sized instruments such as violins and violas.

FIG. 6 illustrates a two sided larger size peg turner, 60, for example configured as turner 10 or 40, and that can accommodate both large orchestral instrument pegs and standard (or smaller) sized orchestral instrument pegs (e.g., violins and violas, and cellos and contrabass instruments). It is also similar to the larger or smaller peg turner, 50, described in FIG. 5, above, with the addition of a standard size slot, 61, for example configured as slot 12 (or 24), formed on the hand or palm grip side, 51 (or 40B), of the turner, 60, opposite the larger slot, 53, on the turner or grip side, 63 (or 40B), of the body, 11, of the peg turner, 60. Similar to other turners, for example 10, 40, and 50, as described above, the slots, for example slot 12, 24, 53, or 61, are optionally formed with tapered walls, 12B, above, that in turn are optionally covered with a soft material layer, 14.

In some designs, a knurl, groove, or taper, 64, is provided to improve grip, force and torque transfer, between the grip end, 52, and the slot end, 63, as shown in FIG. 6. In this particular example, taper or stepdown 64 is formed about the turning axis, A, in order to transition from a first (e.g., smaller) diameter of the first end (e.g., a turning end, 51) to a second (e.g. larger) diameter of the second end (e.g., a grip end, 63), or vice-versa.

Figure 7:
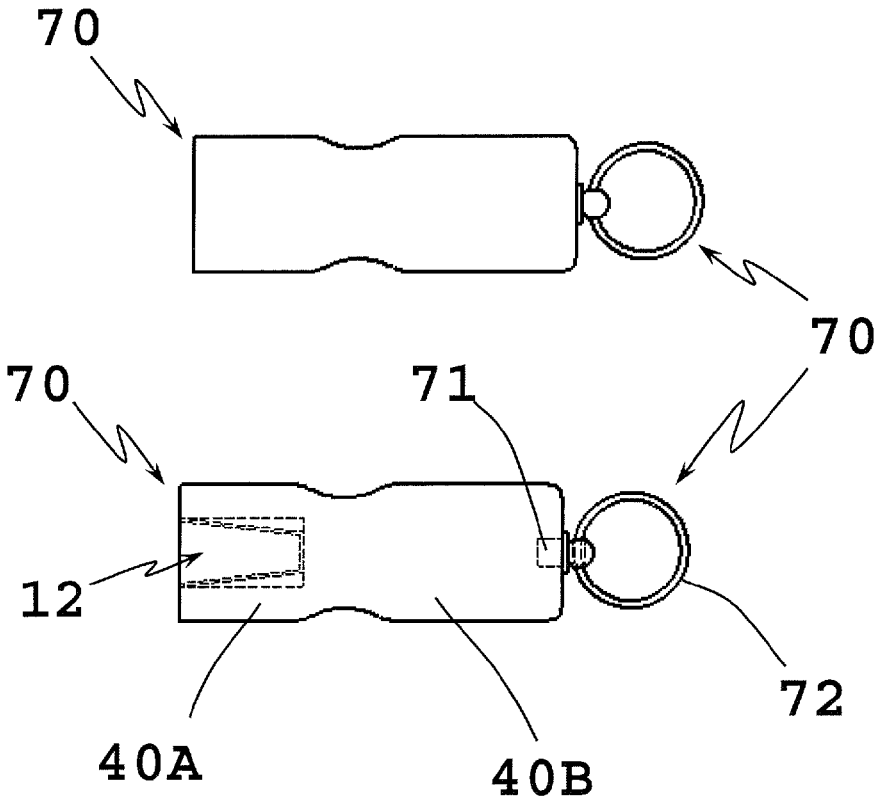
FIG. 7 illustrates an example of how a key-chain or lanyard may be attached to the peg turner.

FIG. 7 shows external (top) and internal (bottom) views of a peg turner, 70, for example peg turner 10, 40, 50, or 60, above, with a keychain or hooking mechanism, 70, so that the peg turner may be connected to a chain, string, rope, or lanyard. This example shows a key ring plug, 71, that inserts into the turner grip or second end, 40B, such that a key ring or other coupling device, 72, may be securely fastened to the peg turner, 70. Incorporation of coupling device 72 in the form of rings, hooks, strings, or chains is also envisioned for other peg turner designs, sizes, and styles.

Figure 8:
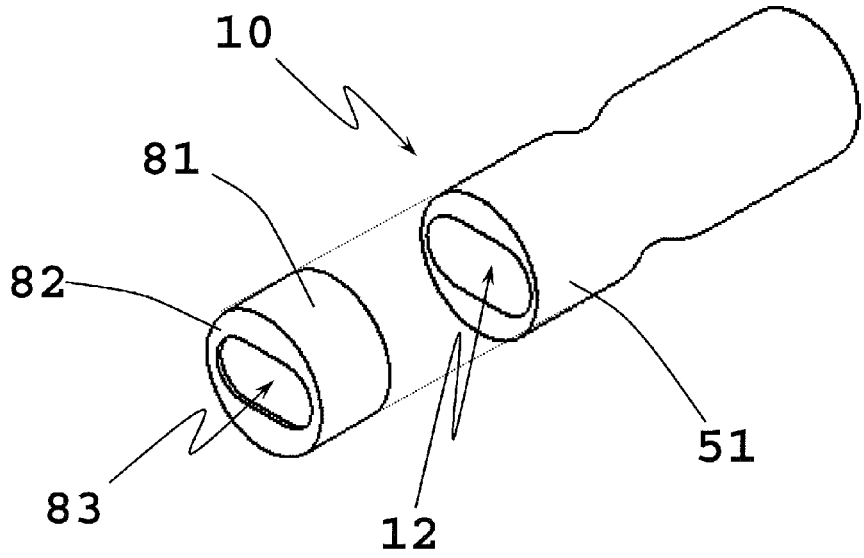
FIG. 8 shows an example of a peg turner with a protective rubber or plastic cap.

FIG. 8 illustrates how an optional soft cap, 81, may be incorporated on the slot end or peg turner head, 51, of a peg turner, 10 (or 40, 50, 60 or 70), to provide an engaging surface, 82, that will reduce or minimize the possibility of accidentally scratching or marring the instrument peg box. Said soft cap, 81, is preferably constructed with a rubber, latex or other soft plastic material. Said soft cap, 81, contains a cap slot, 83, through which pegs may pass, for example as configured to accommodate the dimensions of a peg slot, 12, (or 24, 41, 42, 53, or 61), at an opening, 36, as described above.

It is envisioned that peg turners, 10 (or 40, 50, 60 or 70), may be constructed from a wide variety of materials. Molded plastic technology provides a means to quickly manufacture a multitude of peg turners at low cost. There are a great variety of wooden materials that provide unique appeal and aesthetically pleasing feel, combined with structural and machining advantages. Exotic woods, such as ebony and rosewood, are commonly used as the base wood material for orchestral instrument pegs and are prized by instrumentalists because of their superior strength, hardness and durability. Metal materials, such as steel or copper, also provide enhanced strength and durability.

Figure 9:
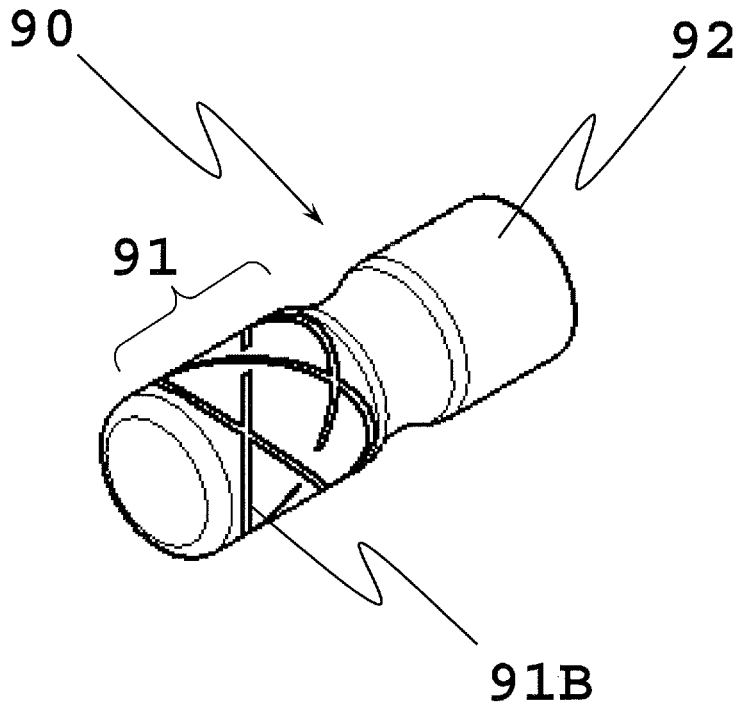
FIG. 9 displays an example of an aesthetically pleasing and functional grip design, for example a Celtic Cross design in the grip end of the peg turner.
Figure 10:
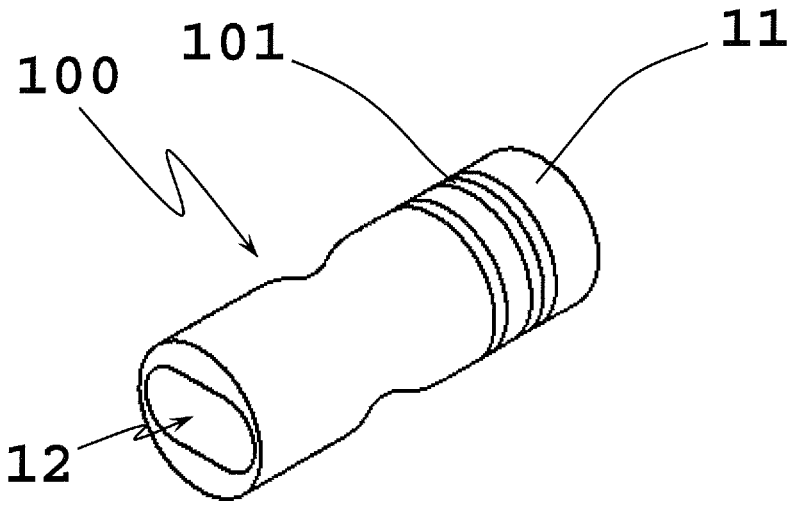
FIG. 10 shows an example of a multi-layer cross pattern grip design in the peg turner.

It is envisioned that aesthetically pleasing and structurally or functionally enhanced designs such as those illustrated in FIG. 9 and FIG. 10 may be incorporated into the peg turners. FIG. 9 illustrates a turner, 90, for example turner 10, 40, 50, 60 or 70, above, with a crisscross pattern, 91, to improve hand and palm frictional coupling, gripping, and force and torque transfer from the palm to the peg turner body, 11. This particular cross pattern is known in the wood turning art as a Celtic Cross design, but a variety of other grip patterns may be provided. The cross may be formed by providing thin layers, 91B, of an alternate material at various angles before turning down the elongated handle, 92, for example configured as a handle or peg turner body, 11, as described above. This design provides a combination of different materials in the peg turner body, 92, for improved friction and gripping capability, with less slipping.

Similarly, a multi layered pattern turner, 100, may be created as illustrated in FIG. 10, for example peg turner 10, 40, 50, 60, 70 or 90, above. This style shows a multitude of differing layers, 101, incorporated into the turner body, 11. The layers in either of these aesthetically, structurally and functionally enhanced peg turners may be from an alternate wood variety, metal, or plastic material, in order to increase friction for less slipping and improved peg turning performance.

Figure 11:
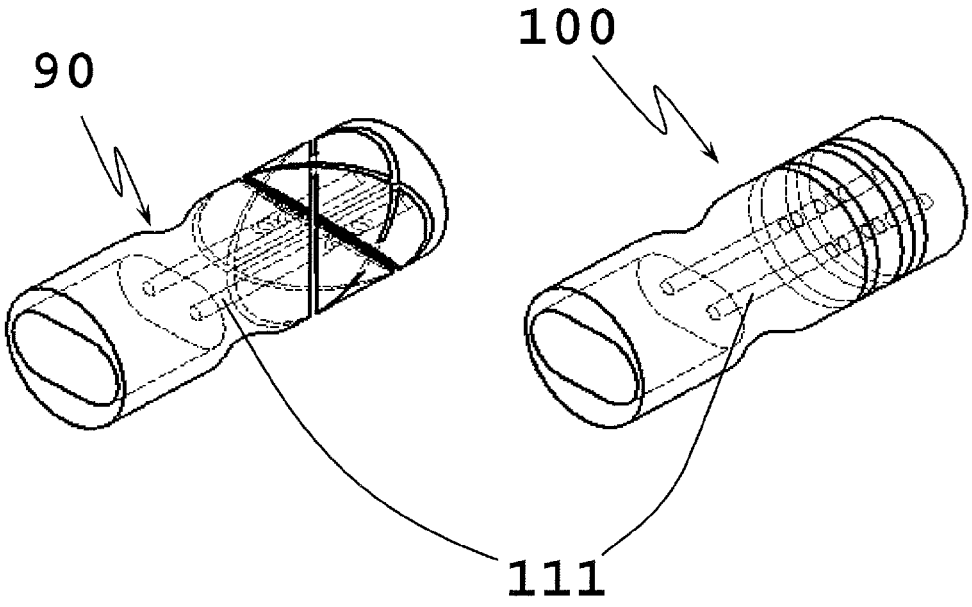
FIG. 11 shows a peg turner with strengthening or reinforcing rod elements.

One challenge with incorporating various layered or cross designs in the peg turner is that the resultant glue joints used in other designs may weaken the overall hand or palm grip structure. FIG. 11 illustrates one means by which the peg turner may be strengthened or reinforced to improve strength and durability, as compared to these other designs. This illustration indicates a standard sized or other peg turner, for example peg turners with a Celtic Cross design, 90, and with a multilayer, 100, design, or other peg turners 10, 40, 50, 60, or 70, above. A series of reinforcing rods, 111, are placed inside the device to strengthen the handle integrity. These rods are inserted, for example, from the slot side of the turner and in some designs they do not extend to the turner base or grip side. Thus, when complete, the rods are not noticed or may not be substantially visible from the turner exterior.

Several methods are envisioned to form a preferred soft material layer coated tapered slot peg turner device. The preferred method consists of creating an elongated handle with a palm grip and then forming an ovate cylindrical or oblong slot. A tapered plug or forming insert element covered with a soft material layer is inserted into the ovate cylindrical hole that is at least partially filled and coated with a hardening resin, epoxy, glue, or other bonding or filling material. After the hardening resin or other material sets to a solid form, or after suitable bonding and tapered slot wall shaping is achieved, the tapered plug or form element is removed to reveal a tapered slot that has a soft material layer.

An alternate method to form a tapered peg slot turner is to create a specially designed plastic mold and resin or other material for forming at least one of the peg turner body, one or more slots, and one or more knurls, grooves, tapers, cross patterns, laminated portions or other features. In some designs the peg turner is formed with a substantially one-piece body portion, and in other designs additional machining, lathing, binding and other steps are included to form or attach one or more of the slots and grip or other turning features. Another possible method to form a tapered peg slot turner is to use specially designed tapered drill bits or tools to form the slots, and to provide for reinforcing rods or other structural features. Alternately, a computer controlled milling machine could be used to form one or more of a peg turner body, tapered slot, knurl, groove, taper grip, and cross or multi-layered friction feature, in any combination with the other features described above.

Figure 12:
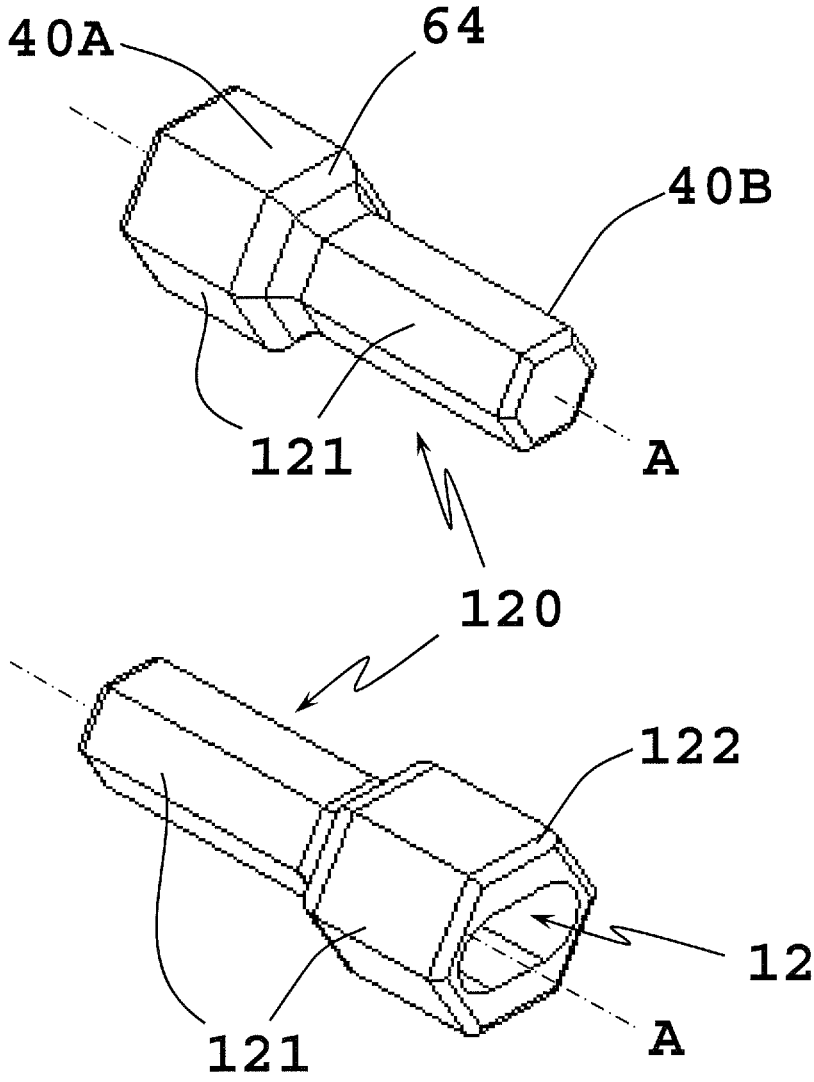
FIG. 12 illustrates a multi-sided or multi-faceted peg turner design.

An additional example of a peg turner, for example peg turner, 120, configured as or similar to peg turner 10, 40, 50, 60, 70, 90, or 100, above, is shown in FIG. 12, in opposing end views. In this particular design, the peg turner, 120, is configured with a multi-sided or multi-faceted design for the peg turner body, 11, with substantial symmetry about the rotational axis, A. The multi-sided design may incorporate two, three, four, five, six, seven, eight or more different sides, 121, for example in a hexagonal design having a corresponding six-fold rotational symmetry as shown, based on the number of sides, in order to improve hand and palm grip performance for increased force and torque transfer from the palm through the peg turner body to the selected tuning peg, with reduced stress and strain on the user, and reduced risk of injury.

The peg turner, 120, may be provided with one or more peg turner slots, for example one or more peg slots 12, 24, 41, 42, 53, and 61, above, of various sizes and dimensions, as provided in one or both opposing ends, 40A and 40B, of the peg turner body. The sides, 121, may be provided on one or both of the ends, 40A and 40B, and may be substantially regular and planar, shown in FIG. 12, or more rounded, or irregular. In additional designs, the opposing ends, 40A and 40B, may be provided with a taper or chamfer, 122, in order to reduce the risk of scratching and other damage to the peg box and instrument.

In further examples, a knurl, taper, or other grip feature, 64, may be provided between the opposite ends, 40A and 40B, in order to improve force and torque transfer. In addition, either end 40A or 40B may be larger or smaller than the other, for example a larger grip end and a smaller slot end, or vice-versa in order to accommodate different hand and tuning peg sizes and configurations, or to improve ergonomic performance and reduce stress on the user. Alternatively, the opposite ends, 40A and 40B, may be of substantially similar size.

In additional aspects of the invention, a peg turner is provided, comprising a handle and a slot formed on one end. The peg turner may be provided wherein the slot is formed with tapered walls. The peg turner may be provided wherein the slot is covered with soft material layer. The peg turner may be provided wherein the soft material layer is leather, wherein the soft material layer is rubber and wherein the soft material layer is latex.

The peg turner may be provided wherein the slot is sized to accommodate a variety of standard violin or viola pegs, wherein the slot is sized to accommodate a variety of student size violin pegs and wherein the slot is sized to accommodate a variety of cello pegs. The peg turner may be provided wherein the handle incorporates a keychain, wherein the end of the handle with the slot is covered with a soft protective cap and wherein the opposing end of the handle also contains a slot.

A method for forming a tapered peg turner may comprise: forming a peg turner handle; forming an ovate cylindrical slot; partially filling said slot with a hardening resin; inserting a tapered plug into said partially filled slot; allowing said hardening resin to set; and removing said tapered plug. The method may be performed wherein the tapered plug is covered with a soft material layer prior to insertion into said partially filled slot.

While this invention is described with reference to exemplary embodiments, it will be understood by those skilled in the art that various changes may be made, substantial equivalents may be substituted, and modifications may be made to adapt the teachings of the invention to additional applications, materials and situations, without departing from the spirit and scope thereof. The invention is thus not limited to the particular examples that are disclosed herein, but encompasses all embodiments falling within the scope of the appended claims.

The invention claimed is:

1. A peg turner for a stringed instrument having a peg box and a plurality of tuning pegs therein, the peg turner comprising:

an elongate body portion extending along an axis, the body portion defining first and second opposing ends;

a recess formed in the first end of the body portion;

a tapered peg turner slot formed in the recess, the tapered peg turner slot comprising:

an opening on the first end of the body portion, the opening sized to accept a selected tuning peg of the plurality of tuning pegs; and tapered sides extending from the opening along the peg turner slot toward the second end, the tapered sides tapering inward along the axis to form a compressive coupling for turning the selected peg about the axis with the body portion of the peg turner;

a soft material layer provided on an interior surface of the tapered sides, the soft material layer forming the compressive coupling with the selected tuning peg; and a filler material disposed between the soft material layer and an inner surface of the recess, the filler material defining a shape of the tapered sides along the soft material layer.

2. The peg turner of claim 1, wherein the first end of the body portion is provided with a soft cover to interface with the peg box while rotating the selected tuning peg of the plurality of tuning pegs.

3. The peg turner of claim 2, wherein:

the opening has a width of about one half inch to about two inches and a breadth of about one half inch to about one inch, such that the opening accommodates a tuning peg of a cello or contrabass; and the peg turning slot tapers to a slot depth of about one half inch to about two inches to form a compressive coupling with the selected tuning peg along the tapered sides of the slot, for rotation of the selected cello or contrabass peg about the axis.

4. The peg turner of claim 1, wherein:

the opening has a width of about one half inch to about one and one half inches and a breadth of about two tenths of an inch to about six tenths of an inch, such that the opening accommodates the selected tuning peg of a violin or viola; and the peg turning slot tapers to a slot depth of about one half inch to about one and one half inches to form a compressive coupling with the selected tuning peg along the tapered sides of the slot, for rotation of the selected violin or viola peg about the axis.

5. The peg turner of claim 1, further comprising a groove or knurl formed on the body portion between the first end and the second end, the groove or knurl extending about the axis and configured for torque transfer from a user through the peg turner to the selected tuning peg.

6. The peg turner of claim 1, further comprising a taper formed on the body portion between the first end and the second end, the taper extending about the axis to transition from a first diameter of the first end to a second diameter of the second end.

7. The peg turner of claim 6, further comprising a second tapered peg turner slot in the second end of the body portion.

8. The peg turner of claim 1, further comprising a reinforcing element provided within the body portion, the reinforcing element extending from the tapered slot and along the axis toward the second end.

9. The peg turner of claim 1, further comprising a grip feature formed on the second end of the body portion, the grip feature configured in a cross pattern for increased friction between the second end of the body portion and a palm of a user.

10. The peg turner of claim 1, wherein the body portion is defined within a plurality of substantially planar sides.

11. A method comprising:

forming an elongate body, the elongate body defining first and second ends opposed along a rotational axis;

forming a recess in the first end of the elongate body, the recess extending along the rotational axis; and forming a tapered peg turner slot in the recess, wherein forming the tapered peg turner slot comprises:

forming a soft material layer about an insert, the insert having tapered sides configured to grip a tuning peg of a string instrument for rotation about the rotational axis with the elongate body;

coating an interior of the recess with an adhesive material;

inserting the insert into the recess along the rotational axis, such that the adhesive material substantially fills an inner volume between the soft material layer and an inside of the recess; and removing the insert, such that the tapered peg turner slot presents an opening in the first end of the elongate body, the opening configured for accepting the tuning peg of the string instrument.

12. The method of claim 11, further comprising sizing the insert such that the opening is configured to accept the tuning peg of a violin or viola to form a compressive coupling with the soft material layer along the tapered sides of the peg turner slot for rotation of the tuning peg about the rotational axis.

13. The method of claim 11, further comprising sizing the insert such that the opening is configured to accept the tuning peg of a cello or contrabass to form a compressive coupling with the soft material layer along the tapered sides of the peg turner slot for rotation of the tuning peg about the rotational axis.

14. The method of claim 11, further comprising forming a groove, knurl or taper on the elongate body between the first end and the second end, the groove, knurl or taper configured to position a palm of a user for torque transfer through the elongate body to rotate the tuning peg of the musical instrument about the rotational axis.

15. A peg turning device for a stringed instrument having a peg box and a plurality of tuning pegs therein, the peg turning device comprising:

a peg turner body having a rotational axis and an elongate body portion extending along the rotational axis, the body portion defining first and second opposing ends;

a recess formed in the first end of the peg turner body;

a grip portion formed on the second end of the peg turner body, opposite the first end along the rotational axis;

a tapered peg turner slot formed in the recess, the tapered peg turner slot comprising:

an opening on the first end of the body portion, the opening sized to accept a selected tuning peg of the plurality of tuning pegs of the stringed instrument, the selected tuning peg having a generally flat head; and tapered sides extending from the opening toward the second end, the tapered sides tapering inward along the rotational axis to form a compressive coupling with the head for turning the tuning peg about the rotational axis with the peg turner body;

a soft material layer provided on an interior surface of the tapered sides, the soft material layer forming the compressive coupling with the selected tuning peg; and a filler material disposed between the soft material layer and an inner surface of the recess, the filler material defining a shape of the tapered sides along the soft material layer.

16. The peg turning device of claim 15, the soft material layer further comprising a compressive material disposed along the tapered sides of the peg turner slot to form the compressive coupling when the head of the tuning peg is accepted into the opening.

17. The peg turning device of claim 15, wherein the opening of the peg turner slot is sized to accept the tuning peg of a violin or viola and the tapered sides are tapered inward along the rotational axis to form the compressive coupling with a head of the violin or viola tuning peg.

18. The peg turning device of claim 15, wherein the grip portion is configured to provide mechanical advantage for torque transfer from a hand of a user to the peg turner body.

19. The peg turning device of claim 15, further comprising a second tapered peg turner slot formed in a second recess in the second end of the peg turner body, the second tapered peg turner slot comprising:

an opening sized to accept a tuning peg of a cello or contrabass;

tapered sides extending from the opening toward the second end, the tapered sides tapering inward along the rotational axis to form a compressive coupling with a head of the cello or contrabass tuning peg for rotation about the rotational axis with the peg turner body.

20. The peg turning device of claim 19, further comprising a taper between a first diameter of the first end of the peg turner body and a second diameter of the second end of the peg turner body, the taper configured for torque transfer from a palm of a user to the peg turner body.

21. The peg turning device of claim 15, further comprising a coupling device in the second end of the peg turner body, opposite the tapered peg turner slot, the coupling device configured for coupling to a lanyard or keychain.

* * * * *